US010543887B2

(12) United States Patent
Ziaylek et al.

(10) Patent No.: US 10,543,887 B2
(45) Date of Patent: Jan. 28, 2020

(54) DOCK HANDRAIL AND GATE APPARATUS

(71) Applicant: Michael P. Ziaylek, Yardley, PA (US)

(72) Inventors: Michael P. Ziaylek, Yardley, PA (US); W. Brian McGinty, Huntingdon Valley, PA (US); James Jarozynski, Collingswood, NJ (US)

(73) Assignee: SPECIFIED TECHNOLOGIES INC., Somerville, NJ (US)

( * ) Notice: Subject to any disclaimer, the term of this patent is extended or adjusted under 35 U.S.C. 154(b) by 211 days.

(21) Appl. No.: 15/707,304

(22) Filed: Sep. 18, 2017

(65) Prior Publication Data

US 2018/0079470 A1 Mar. 22, 2018

Related U.S. Application Data

(60) Provisional application No. 62/395,867, filed on Sep. 16, 2016.

(51) Int. Cl.
*B63B 17/04* (2006.01)
*B63B 27/00* (2006.01)

(52) U.S. Cl.
CPC ..... *B63B 17/04* (2013.01); *B63B 27/02* (2013.01); *B63B 2017/045* (2013.01)

(58) Field of Classification Search
CPC ..... E04F 11/00; E04F 11/18; E04F 11/181; E04F 11/1812; E04F 11/1814; E04F 11/1817; E04F 11/1846; E04F 11/1863; E04F 2011/1876; B63C 2005/025; Y10T 403/32319; B63B 17/04; B63B 2017/045
See application file for complete search history.

(56) References Cited

U.S. PATENT DOCUMENTS

| | | | | |
|---|---|---|---|---|
| 3,605,851 | A * | 9/1971 | Mlles | A47G 5/00 160/135 |
| 6,199,833 | B1 * | 3/2001 | Bilby | E01F 13/022 256/24 |
| 6,328,285 | B1 * | 12/2001 | Wiseman | E04H 3/123 256/59 |
| 7,055,806 | B2 * | 6/2006 | York, Jr. | E01F 13/022 256/21 |
| 9,194,090 | B2 * | 11/2015 | Raml | E01F 7/025 |
| 9,617,747 | B2 * | 4/2017 | Seto | E04G 21/3228 |
| 2008/0098510 | A1 * | 5/2008 | O'Brien | A47K 17/022 4/576.1 |
| 2012/0126193 | A1 * | 5/2012 | Lin | E06B 11/085 256/67 |

* cited by examiner

*Primary Examiner* — Michael P Ferguson
(74) *Attorney, Agent, or Firm* — Fox Rothschild LLP; Robert J. Sacco

(57) ABSTRACT

A dock handrail gate includes a base plate installable on the surface of the dock and a post mounted to the base plate perpendicular to the base plate. The handrail also has a rail that attaches to the top portion of the post and extends horizontally and inclines downwardly at an angle inwardly towards the post and further attaches to the bottom portion of the post. The handrail may also have an inner tube that includes an inner sleeve to allow the post and the rail to be lifted and rotated to lock into one or more positions.

15 Claims, 4 Drawing Sheets

DOCK HANDRAIL AND GATE APPARATUS

CROSS-REFERENCE TO RELATED APPLICATIONS

This application claims priority to U.S. Provisional Patent Application No. 62/395,867, filed Sep. 16, 2016, the disclosure of which is incorporated herein by reference.

FIELD OF THE INVENTION

This disclosure relates to appliances for docks and particularly to dock handrail and gate for helping passengers disembark or board their boats while at a dock.

BACKGROUND

Most docks today are not equipped with handrails. Even some docks are equipped with handrails or chains, they are often not user friendly, creating dangerous situations when passengers get on or off the boat.

This disclosures describes devices and systems that are intended to fill in a need in the docking industry and address at least some issues discussed above and/or other issues.

SUMMARY

A dock handrail includes a base plate installable on a surface of a dock, a post extending from the base plate perpendicularly, and a rail extending from a top portion of the post perpendicular to the post, inclined downward at an angle inwardly towards the post, returning to the post and attaching to a bottom portion of the post. The dock handrail may also include a cap covering the top end of the post.

The dock handrail may include a hollow space and the dock handrail further includes: an inner tube disposed inside the hollow space of the post aligning with the center axis of the post; a horizontal member crossing the hollow space of the post horizontally and attaching to opposing walls of the post; and an inner sleeve coupled to the top end of the inner tube, wherein the inner sleeve includes multiple fingers and multiple seats formed between the fingers. In some scenarios, the inner sleeve has two or more pairs of seats, each pair having two seats opposing to each other. Each pair of seats is also configured to receive the horizontal member to lock the rail to a first position, and the inner sleeve is configured to allow the horizontal member to be lifted to disengage from the seats above the fingers to be able to rotate freely and to engage with a different pair of seats so that the rail is locked into a second different position.

The dock handrail may additionally include at least two inner rings wrapping around the inner tube and space apart, and one or more locking pins attaching to the post and extending into the hollow space between the two inner rings so that the post is prevented from being removed from the inner tube.

DETAILED DESCRIPTION

This disclosure is not limited to the particular systems, methodologies or protocols described, as these may vary. The terminology used in this description is for the purpose of describing the particular versions or embodiments only, and is not intended to limit the scope.

As used in this document, any word in singular form, along with the singular forms "a," "an" and "the," include the plural reference unless the context clearly dictates otherwise. Unless defined otherwise, all technical and scientific terms used herein have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used herein, the term "comprising" means "including, but not limited to."

Figure 1:
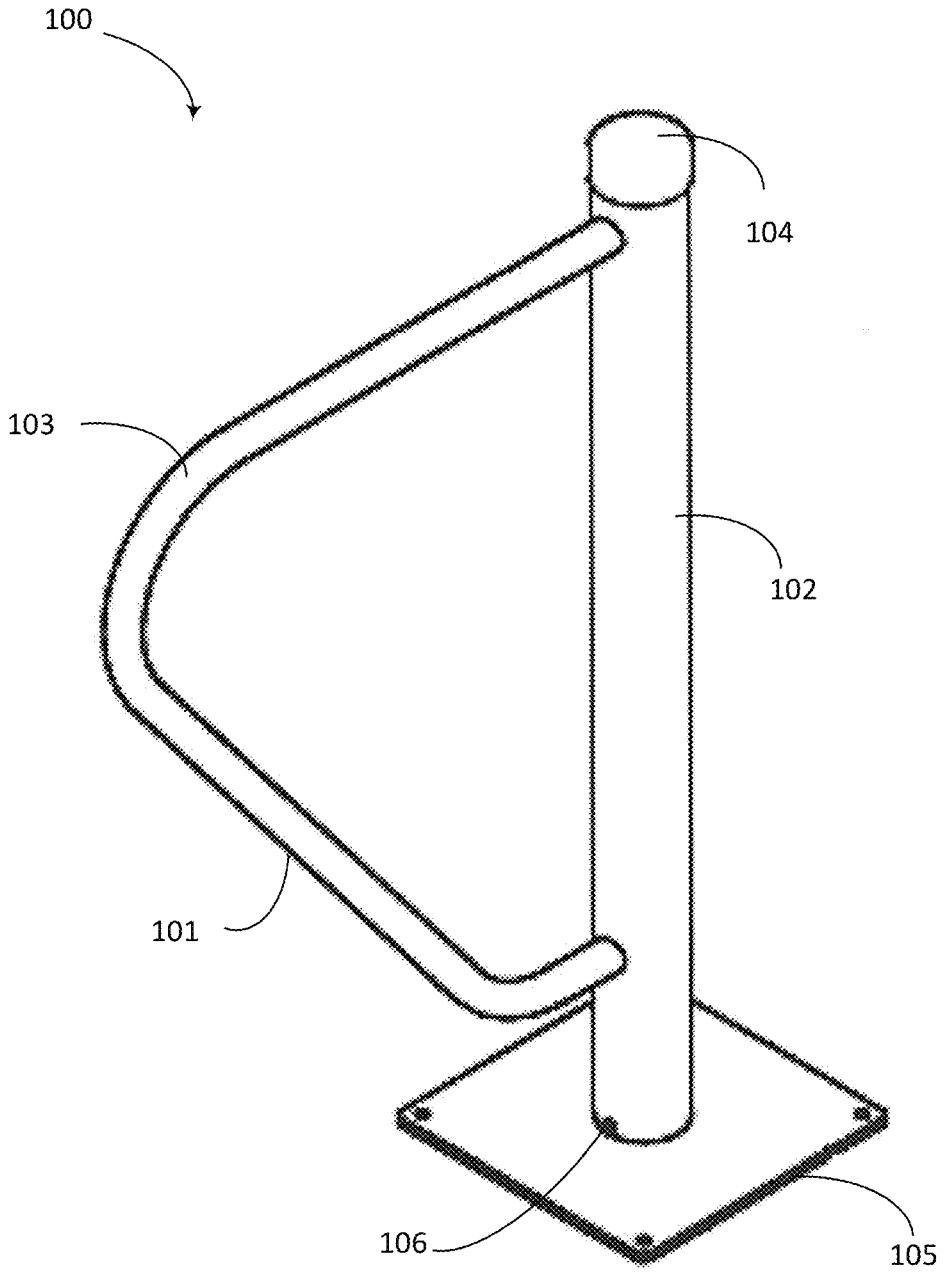
FIG. 1 depicts an example of a dock handrail and gate apparatus according to a preferred embodiment.

With reference to FIG. 1, a single, fixed position handrail 100 is illustrated for helping people disembark or board their boats while at a dock. In a preferred embodiment, handrail 100 includes a base plate 105 installable on the surface of a dock, a post 102 extending from the base plate perpendicularly, a rail 103 attaching to a top portion of the post 102 and extending perpendicularly from the top portion of the post, inclined downward at an angle 101 inwardly towards the post 102, returning to the post 102 and attaching to a bottom portion of the post 102. The lower part of the rail 101 is at an angle, e.g., in a range from 15 to 85 degrees with respect to the post 102, to allow ease of grabbing for a passenger while still on the boat regardless of boat height or water level height. It is also set so as to not interfere with the boat.

Base plate 105 may have different sizes to suit spatial limitation and different requirements. For example, the base plate for the handrail is 9" by 9" and has four mounting holes to allow for attachment to the dock in a fixed position using a variety of hardware. The base plate may be extended to a larger size to allow for better mechanical advantage to loading.

Post 102 may have various shapes and sizes. For example, the post may be a tube and hollow. It may also be of square shape (in cross section) and hollow as well. The height of the post can also vary in height depending on the application. The material of the handrail 100 may include, but is not limited to: polished stainless steel, anodized aluminum and powder coated aluminum.

The post 102 may include a cap 104 installable at the top of the post to prevent rain from coming into the post. The cap can be made of plastic or metal or other materials. The post 102 may also include at least one draining hole 106 at the bottom of the post where it is attached to the base plate. This hole drains any water that has accumulated inside the post, preventing moisture from building up inside the post.

Figure 2A:
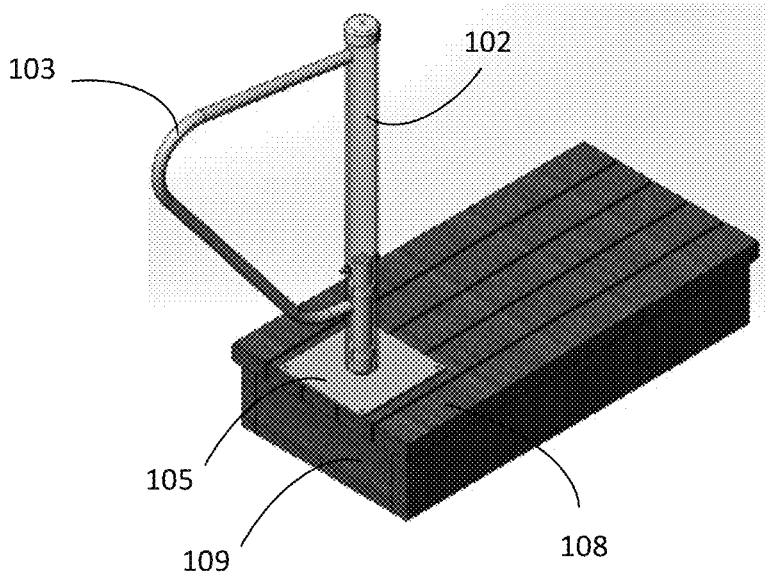
FIGS. 2A and 2B depict a handrail and gate being at different positions.
Figure 2B:
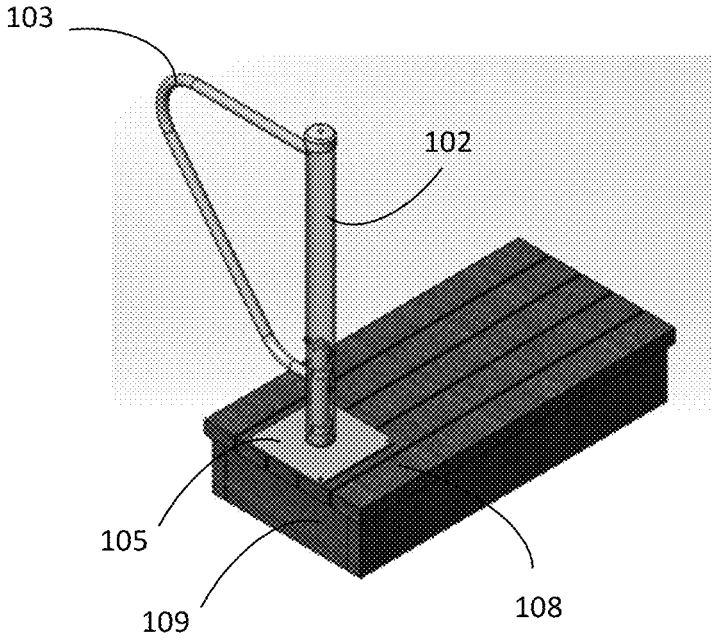

With reference to FIGS. 2A and 2B, the base plate 105 is installable on a dock surface 108. Variations of the handrail are provided for assisting passengers disembarking or boarding their boats. For example, the rail 103 can be configured to rotate to different positions to suit different needs. In FIG. 2A, the rail 103 can be configured to extend beyond the edge of the dock to make it easier for a passenger to grab. In FIG. 2B, the rail 103 can be configured to rotate 90 degrees and move out of the way so that it is aligned with the edge of the dock and does not block the boat from coming into the dock.

Figure 3:
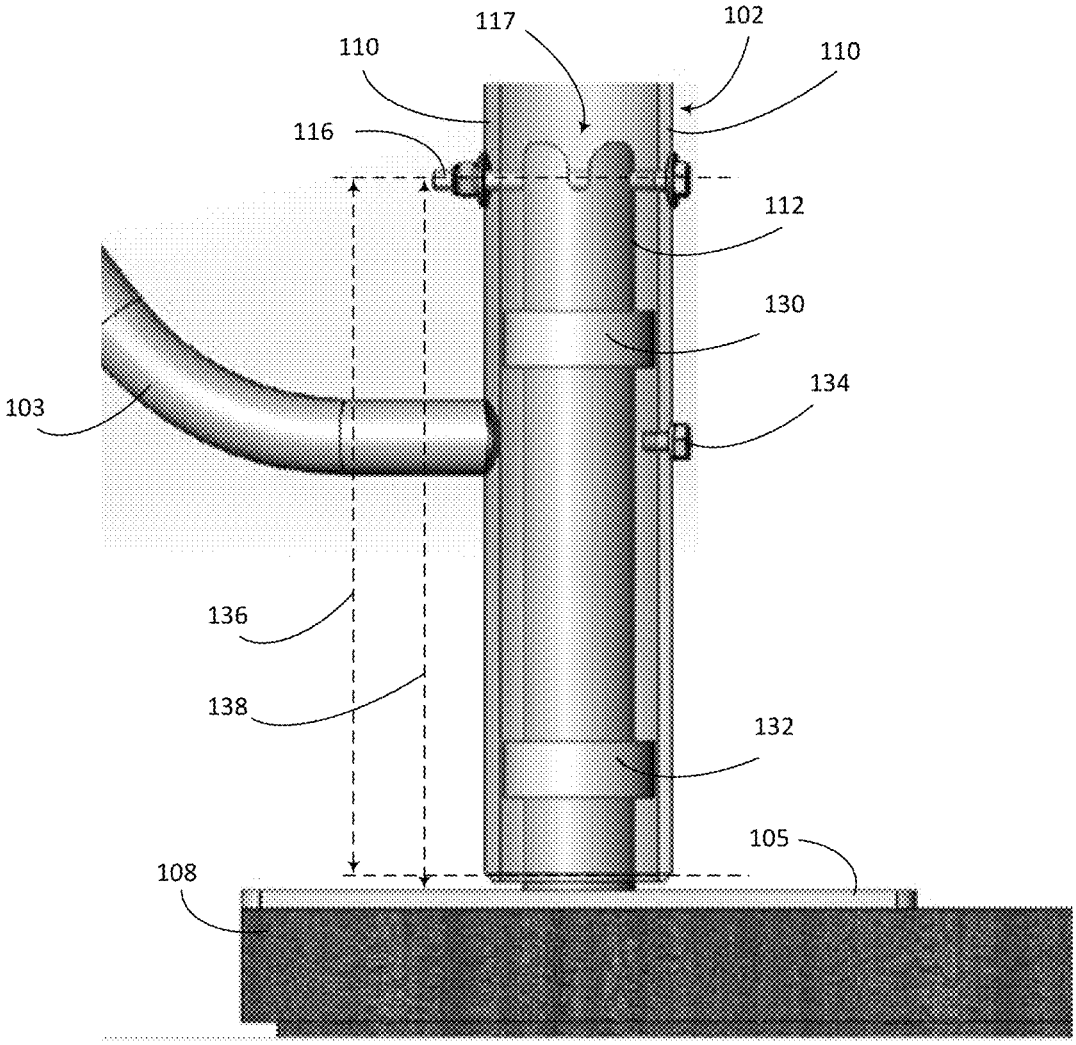
FIG. 3 depicts an example of a structure for rotating the handrail and gate.

With reference to FIG. 3, a structure for rotating the rail of the handrail is further described. The post 102 may be hollow and have an outer shell/wall 110, to which the rail 103 is attached. The handrail includes an inner tube 112. The inner tube 112 is attached to the base plate at a bottom end. The inner tube 112 may be welded to the base place or fixedly attached to the base plate by bolts and nuts. The inner tube 112 extends vertically from the base plate 105 and positioned to be disposed inside the hollow space of the post 102 to align longitudinally with the center axis of the post.

The handrail further includes a horizontal member 116 that extends crossing the hollow space of the post 102 horizontally and fixedly attaching to opposing sides of outer shell/wall 110 of the post 102. The handrail also includes an inner sleeve 117 coupled to a top end of the inner tube 112, wherein the inner sleeve 117 is positioned to engage with the horizontal member 116 to allow the post to rotate about the center axis thereof. This is further explained with reference to FIG. 4.

Figure 4:
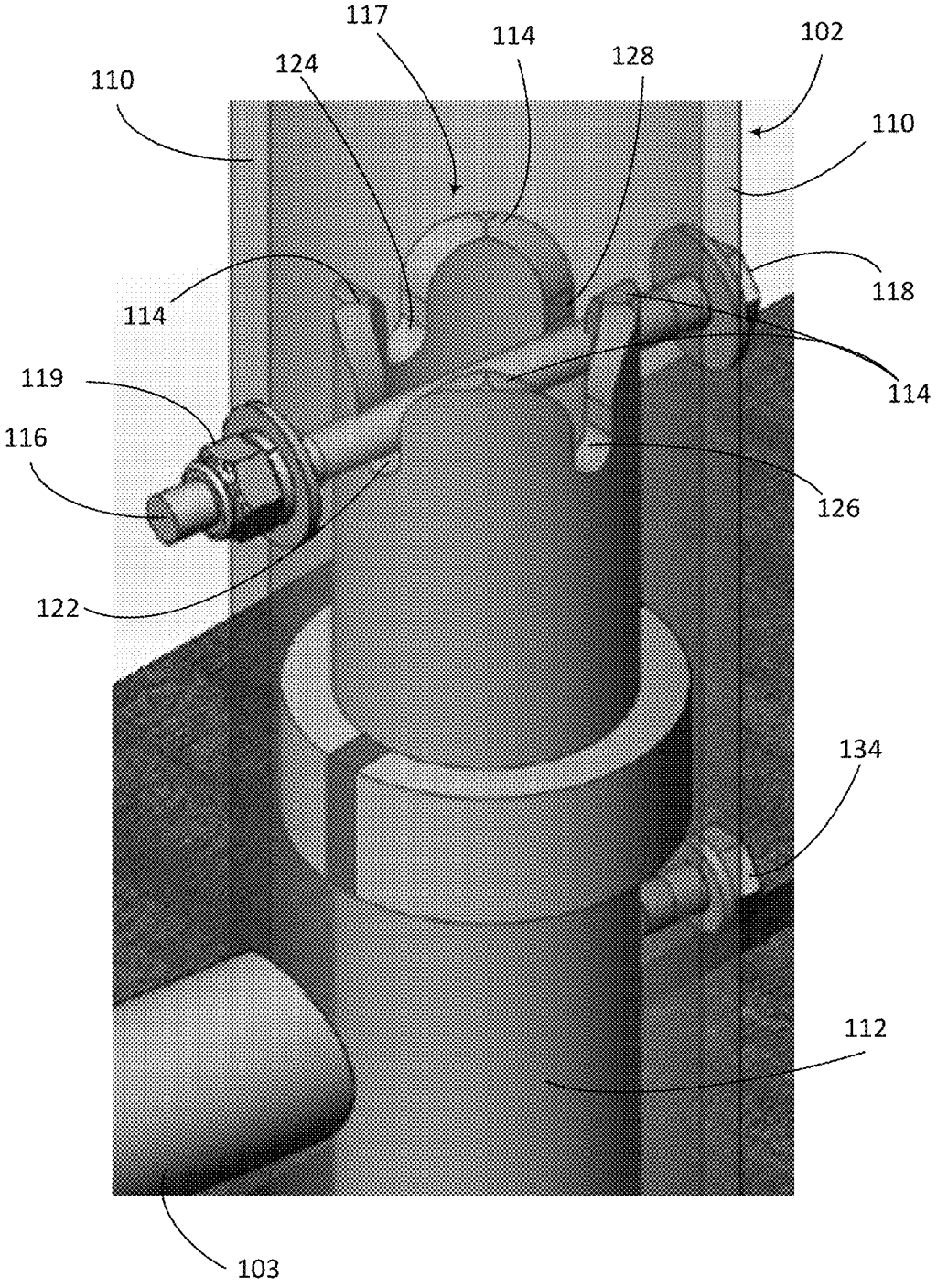
FIG. 4 depicts an example of details of the inner sleeve structure in FIG. 3.

In FIG. 4, the inner sleeve 117 includes multiple fingers 114 forming in between a plurality of seats, e.g., 112-128. At least one of the plurality of seats, such as 122, 128, is positioned to engage with the horizontal member 116 so that the rail 103 is locked into a locking position.

The outer shell/wall 110 is configured to freely rotate about its center axis and about the inner tube 112. In particular, the inner sleeve 117 is positioned to allow the horizontal member 116 to disengage from the at least one of the plurality of seats, via a lifting action of the post, so that the horizontal member 116 is pulled upwardly and above the multiple fingers, at which point the horizontal member 116 becomes rotatable about the center axis of the post to be able to re-engage with a different seat of the inner sleeve so that the rail is locked into a different position. This rotation is done by the user lifting the outer shell/wall 112 (together with the rail mounted thereto), rotating it to a desired position and releasing it down to lock in position.

The inner sleeve 117 may have various configurations. For example, the inner sleeve 117 may be formed directly on the edge of the top end of the inner tube 112 to have multiple fingers 114 and multiple seats 122-128. Alternatively, the inner sleeve 117 can be a separate component that is attached to the top end of the inner tube 112. The horizontal member 116 may be a rod that is installed on the outer shell/wall 110 of the post 102 post perpendicularly with respect to the center axis of the post 102. The rod may be a bolt 118 that goes through opposing walls of the outer shell/wall 110 and fixed to the outer shell via a nut 119.

With further reference to FIG. 4, the inner sleeve 117 may have two pairs of seats, each pair having two seats facing each other and positioned to engage the horizontal member 116 simultaneously. For example, seats 122, 128 are facing each other; and seats 124, 126 are facing each other. This provides four positions for the rail. For example, the rail can be installed at a position for which the horizontal member 116 seats across (i.e., engages) two opposing seats in the pair simultaneously, such as 122, 128 or 124, 126. A method of changing the handrail disclosed above will be further described in detail below.

The horizontal member 116 seats cross two opposing seats in the inner sleeve (122, 128). The user may lift (pull upward) the rail 103 and the outer shell of the post 102 so that the horizontal member 116 is moved upward and disengages from the seats 112, 128. The user may pull the post high enough such that the horizontal member 116 passes above the fingers 114. At that point, the user can then rotate the rail while being lifted, for example, 90 degrees, so that the horizontal member 116 is aligned with seats 124 and 126 in the inner sleeve. Then, the user may release the rail so the horizontal member 116 is dropped into the seats in the inner sleeve to lock the rail to the inner sleeve in a different position.

The user may lift the rail again and continue rotating 90 degrees so that the horizontal member is aligned with the same two seats 128, 122 in the initial position but with the horizontal member 116 rotated at completely 180 degrees from that initial position. In such a manner, the rail will turn 180 degrees from its initial position. The user may continue lifting and turning to achieve 270 degrees from the initial position or turning more to return the rail to the initial position. Alternatively, and/or additionally, the inner sleeve can have more or fewer fingers (and seats) to accommodate more or fewer positions.

The above described feature of changing positions of the rail makes the handrail applicable for various additional applications around the dock. For example, the user may rotate the rail so that the rail extends out beyond the edge of the dock (see FIG. 2A), or the rail is positioned within the edge of the dock (see FIG. 2B). The multi-position handrail disclosed above may also be installed on the dock and used as a gate to keep people from boarding a boat until desired, such as with a chartered boat. It can then be lifted and turned 90 degrees to allow passage.

Returning to FIG. 3, optionally, the handrail may include two or more internal inner rings 130, 132 disposed inside the hollow space of the post 102. The inner rings 130, 132 are spaced apart longitudinally along the inner tube 112 and wrapping around the inner tube 112 of the post 102. The inner rings 130, 132 may be attached to the inner tube 112 in various ways. For example, the inner rings 130, 132 may be welded or screwed to the inner tube 112. The handrail may further include one or more locking pins 134 attaching to the post 102, extending through the outer shell/wall of the post 102, and protruding into the hollow space of the post between the two inner rings 130, 132 so that the post 102, when pulled upward to rotate, is prevented from being removed from the inner tube 112. The locking pins may be a set of screws that are screwed into the outer shell/wall of the post 102. The locking pins provide additional stability for the outer shell with respect to the inner tube.

With further reference to FIG. 3, optionally, the post 102 of the handrail may be supported by the base plate 105 or may be exclusively supported by the inner tube 112. For example, a distance 138 between the plurality of seats of the inner sleeve and the bottom end of the inner tube may be slightly larger than the distance 136 between the horizontal member 116 and the bottom end of the post so that when the horizontal member 116 is engaged with the inner sleeve, the post is exclusively supported by the inner tube 112 and not touching the base plate 105.

The materials for the handrail may include, but is not limited to: polished stainless steel, anodized aluminum and powder coated aluminum. The base plate may be extended to a larger size to allow for better mechanical advantage to loading. The post outer shell/wall and the inner tube may also have various shapes and sizes. For example, both the outer shell/wall and the inner tube can be of tubular design such that an inner tube is disposed inside the outer shell tube.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A dock handrail apparatus comprising:

a base plate installable on a surface of a dock;

a post extending from the base plate perpendicularly and defining a hollow space;

a cap covering a top end of the post;

a rail extending from a top portion of the post perpendicularly, inclined downward at an angle inwardly towards the post, returning to the post and attaching to a bottom portion of the post;

a horizontal member extending across the hollow space of the post horizontally and fixedly attaching to opposing walls of the post;

an inner tube attaching to the base plate at a bottom end, wherein the inner tube extends vertically from the base plate and is positioned to be disposed inside the hollow space of the post to align longitudinally with a center axis of the post;

an inner sleeve coupled to a top end of the inner tube;

wherein the inner sleeve is positioned to engage with the horizontal member to allow the post to rotate about the center axis thereof and lock into position;

wherein the inner sleeve includes a plurality of fingers forming a plurality of seats in between the plurality of fingers;

wherein at least one of the plurality of seats is positioned to engage with the horizontal member so that the rail is locked into a first locking position; and wherein the inner sleeve is positioned to allow the horizontal member to disengage from the at least one of the plurality of seats, via a lifting action of the post, to be able to rotate about the center axis of the post and to re-engage with a different seat of the inner sleeve so that the rail is locked into a different second locking position;

at least two inner rings disposed inside the hollow space of the post and spaced apart longitudinally along the inner tube and wrapping around the inner tube; and one or more locking pins attaching to the post and extending into the hollow space between the two inner rings so that the post is prevented from being removed from the inner tube.

2. The dock handrail apparatus of claim 1 wherein the at least two inner rings are welded to the inner tube.

3. The dock handrail apparatus of claim 2 wherein at least one of the locking pins is a bolt that screws into a wall of the post and protrudes into the hollow space of the post.

4. The dock handrail apparatus of claim 3 wherein the horizontal member is a bolt extending through two opposite walls of the post and attached to the post with a nut.

5. The dock handrail apparatus of claim 4, wherein the plurality of fingers of the inner sleeve are configured to form two or more pairs of the seats, each pair having two seats opposing to each other and positioned to simultaneously engage the horizontal member.

6. The dock handrail apparatus of claim 5 wherein the post includes a draining hole near a bottom end thereof.

7. The dock handrail apparatus of claim 6 wherein a distance between the plurality of seats of the inner sleeve and the bottom end of the inner tube is slightly larger than the distance between the horizontal member and the bottom end of the post so that when the horizontal member is engaged with the inner sleeve, the post is exclusively supported by the inner tube and not touching the base plate.

8. A dock handrail apparatus comprising:

a base plate installable on a surface of a dock;

a post extending from the base plate perpendicularly and defining a hollow space;

a rail having a first end extending from a first location on the post, and a second end extending from a second location on the post, the second location being lower than the first location;

an elongated member extending across the hollow space of the post and fixedly attached to opposing walls of the post;

a tube attached to the base plate at a bottom end of the tube, wherein the tube extends vertically from the base plate and is positioned to be disposed inside the hollow space of the post concentric with the post;

a sleeve coupled to a top end of the tube;

wherein the sleeve is positioned to selectively engage the elongated member to allow the post to rotate about a center axis thereof and lock into position;

wherein the sleeve includes a plurality of fingers forming a plurality of seats in between the plurality of fingers;

wherein at least one of the plurality of seats is positioned to engage the elongated member so that the rail is locked into a first locking position; and wherein the sleeve is positioned to allow the elongated member to disengage from the at least one of the plurality of seats, via a lifting action of the post, to be able to rotate about the center axis of the post and to re-engage with a different seat of the sleeve so that the rail is locked into a different second locking position;

at least two inner rings disposed between the tube and the post and being spaced apart vertically along the tube; and one or more locking pins extending into the hollow space between the two inner rings so that the post is prevented from being removed from the tube.

9. The dock handrail apparatus of claim 8 wherein the at least two inner rings are welded to the inner tube.

10. The dock handrail apparatus of claim 8 wherein at least one of the locking pins is a bolt that screws into a wall of the post and protrudes into the hollow space within the post.

11. The dock handrail apparatus of claim 8 wherein the elongated member is a bolt extending through two opposite walls of the post and attached to the post with a nut.

12. The dock handrail apparatus of claim 8 wherein the plurality of fingers of the sleeve are configured to form two or more pairs of the seats, each pair having two seats opposing to each other and positioned to simultaneously engage the elongated member.

13. The dock handrail apparatus of claim 8 wherein the post includes a draining hole near a bottom end thereof.

14. The dock handrail apparatus of claim 8 wherein a distance between the plurality of seats and the bottom end of the tube is slightly larger than a distance between the elongated member and the bottom end of the post so that when the elongated member is engaged with the inner sleeve, the post is exclusively supported by the tube and not touching the base plate.

15. The dock handrail apparatus of claim 8 wherein the rail extends from the first location on the post perpendicularly to the post, is inclined downward at an angle inwardly towards the post, and returns to the second location on the post.

* * * * *